US007243875B2

(12) United States Patent
Holub et al.

(10) Patent No.: US 7,243,875 B2
(45) Date of Patent: Jul. 17, 2007

(54) METHOD FOR TIGHTLY ROLLING A SLEEPING BAG AND STORAGE SACK THEREFOR

(75) Inventors: Timothy M. Holub, Cheney, KS (US); Michael Wayne Peterson, Park City, KS (US)

(73) Assignee: The Coleman Company, Inc., Wichite, KS (US)

( * ) Notice: Subject to any disclaimer, the term of this patent is extended or adjusted under 35 U.S.C. 154(b) by 342 days.

(21) Appl. No.: 10/864,971

(22) Filed: Jun. 10, 2004

(65) Prior Publication Data

US 2006/0006274 A1 Jan. 12, 2006

(51) Int. Cl.
*B65H 19/28* (2006.01)

(52) U.S. Cl. ..... 242/532.6; 242/587; 242/587.2

(58) Field of Classification Search ..... 242/532.6, 242/587, 587.2, 546.1
See application file for complete search history.

(56) References Cited

U.S. PATENT DOCUMENTS

| | | | | |
|---|---|---|---|---|
| 606,221 | A | | 6/1898 | Kruppa et al. |
| 642,108 | A | | 1/1900 | Gilbert |
| 872,404 | A | | 12/1907 | Burch |
| 917,403 | A | | 4/1909 | Benger |
| 1,159,781 | A | * | 11/1915 | McCoy ..... 242/530.2 |
| 1,341,099 | A | | 5/1920 | Abramson |
| 1,636,838 | A | | 7/1927 | Roser |
| 1,653,815 | A | | 12/1927 | Millar |
| 1,712,448 | A | | 5/1929 | Eckhardt |
| 1,934,360 | A | | 11/1933 | Laufman |
| 2,018,809 | A | | 10/1935 | Rodgers |
| 2,123,454 | A | | 7/1938 | Doppelt |
| 2,454,013 | A | | 11/1948 | Scherzinger |
| 2,720,654 | A | | 10/1955 | Stephenson |
| 2,783,808 | A | | 3/1957 | Renz et al. |
| 2,971,205 | A | | 2/1961 | Shultz |
| 3,042,939 | A | | 7/1962 | Schoellkopf |
| 3,045,261 | A | | 7/1962 | Hocherman |
| 3,292,747 | A | | 12/1966 | Dawson |
| 3,477,552 | A | | 11/1969 | Goldman |
| 3,633,227 | A | | 1/1972 | Tegeler |

(Continued)

FOREIGN PATENT DOCUMENTS

| | | |
|---|---|---|
| CA | 2265337 A1 | 9/1999 |

(Continued)

*Primary Examiner*—William A. Rivera
*Assistant Examiner*—Sang Kim
(74) *Attorney, Agent, or Firm*—Leydig, Voit & Mayer, Ltd

(57) ABSTRACT

A tightly rolled sleeping bag. The tightly rolled sleeping bag is rolled using conventional equipment, but pressure is applied to an end of the sleeping bag so as to cause the sleeping bag to be more tightly rolled than previous sleeping bags. Rolling tines for a rolling machine for rolling the sleeping bag are tapered so as to aid in removal of the tightly rolled sleeping bag. A storage sack is provided for holding the sleeping bag. The storage sack is configurable between a first arrangement where the storage sack holds the sleeping bag in the tight configuration, and a second arrangement where the storage sack may be released and expands to hold the sleeping bag in a less tightly rolled configuration. To provide such a function, an expansion section is provided on the storage sack. A closure is provided on the expansion section.

4 Claims, 4 Drawing Sheets

U.S. PATENT DOCUMENTS

| | | | | |
|---|---|---|---|---|
| 3,750,202 | A | 8/1973 | Merikallio | |
| 4,068,564 | A * | 1/1978 | Dahlstrom | 493/462 |
| 4,153,146 | A | 5/1979 | Patton et al. | |
| D254,220 | S | 2/1980 | Davis | |
| 4,192,226 | A * | 3/1980 | Agostinelli | 493/297 |
| 4,223,056 | A | 9/1980 | Di Fronzo | |
| 4,265,414 | A * | 5/1981 | Spradling | 242/532.6 |
| 4,266,740 | A * | 5/1981 | Ramos et al. | 242/532.6 |
| 4,311,288 | A * | 1/1982 | Galland | 242/532.6 |
| 4,312,431 | A | 1/1982 | Corey | |
| 4,334,601 | A | 6/1982 | Davis | |
| 4,361,215 | A | 11/1982 | Sawai | |
| 4,375,111 | A | 3/1983 | Hall | |
| D280,264 | S | 8/1985 | Lipsig | |
| 4,574,397 | A | 3/1986 | Dennard | |
| 4,575,876 | A | 3/1986 | Weaver | |
| D283,465 | S | 4/1986 | Allen | |
| 4,587,682 | A | 5/1986 | Schultz | |
| 4,603,432 | A | 7/1986 | Marino | |
| 4,604,765 | A | 8/1986 | Schultz | |
| 4,738,545 | A | 4/1988 | Westgor | |
| 4,757,832 | A | 7/1988 | Russell | |
| 4,774,734 | A | 10/1988 | Mills | |
| 4,789,247 | A | 12/1988 | Schnoor | |
| 4,830,154 | A | 5/1989 | Gerch et al. | |
| 4,856,912 | A | 8/1989 | Damus et al. | |
| 4,919,240 | A | 4/1990 | Tobias | |
| 4,953,673 | A | 9/1990 | Ambasz | |
| 4,980,935 | A | 1/1991 | Kazanowski et al. | |
| 5,088,139 | A | 2/1992 | Bloom | |
| 5,110,219 | A | 5/1992 | Lopes | |
| 5,125,547 | A | 6/1992 | Russell | |
| 5,184,361 | A | 2/1993 | Canter et al. | |
| 5,195,828 | A | 3/1993 | Bush-Rodriquez | |
| 5,287,571 | A | 2/1994 | Rademacher | |
| 5,307,908 | A | 5/1994 | Shyr et al. | |
| 5,324,115 | A | 6/1994 | Weinreb | |
| 5,346,308 | A | 9/1994 | Buhot et al. | |
| 5,404,600 | A | 4/1995 | DeMars | |
| 5,505,404 | A * | 4/1996 | Dubreuil | 242/532.6 |
| 5,509,141 | A | 4/1996 | Saltzman | |
| 5,566,901 | A * | 10/1996 | Wilder | 242/532.6 |
| 5,644,807 | A | 7/1997 | Battistella | |
| 5,785,219 | A | 7/1998 | Kraft | |
| 5,787,504 | A | 8/1998 | Wu | |
| 5,815,833 | A | 10/1998 | Kuo | |
| 5,887,301 | A | 3/1999 | Anderson | |
| 5,920,931 | A | 7/1999 | Zuehlke et al. | |
| 5,941,638 | A | 8/1999 | Fonseca | |
| 5,961,061 | A * | 10/1999 | Stanley | 242/395 |
| 6,059,078 | A | 5/2000 | Nykoluk | |
| 6,161,665 | A | 12/2000 | Hoover | |
| 6,202,910 | B1 | 3/2001 | Swetish | |
| D444,298 | S | 7/2001 | Starck | |
| D447,632 | S | 9/2001 | Gisser | |
| 6,367,083 | B1 | 4/2002 | November | |
| 6,438,774 | B1 | 8/2002 | Michaelis et al. | |
| D473,375 | S | 4/2003 | Goeckeritz | |
| 6,595,687 | B2 | 7/2003 | Godshaw et al. | |
| 6,606,839 | B1 * | 8/2003 | Suda et al. | 53/430 |
| 6,676,009 | B1 | 1/2004 | Rose | |
| 6,811,110 | B2 * | 11/2004 | Tsao | 242/530.2 |
| 6,966,439 | B2 | 11/2005 | Weleczki | |
| 2002/0104162 | A1 | 8/2002 | Stewart | |
| 2006/0006274 | A1 | 1/2006 | Holub et al. | |

FOREIGN PATENT DOCUMENTS

| | | |
|---|---|---|
| EP | 0404448 A2 | 12/1990 |

* cited by examiner

METHOD FOR TIGHTLY ROLLING A SLEEPING BAG AND STORAGE SACK THEREFOR

TECHNICAL FIELD OF THE INVENTION

The present invention is directed to sleeping bags, and more particularly to a sleeping bag that is compressed into a roll for storage and transportation.

BACKGROUND OF THE INVENTION

In general, a sleeping bag is a bag that is warmly lined or padded for sleeping outdoors, for example in a a tent. Sleeping bags may also be used for sleeping on the floor inside a house, such as on a sleepover, or may be used as convenient bedding material when traveling.

Sleeping bags typically include a bottom portion, upon which an individual within the sleeping bag lays, and a top portion which extends over to cover the individual. Often, the top and bottom portions are made of a single, large rectangular insulated or padded fabric that is folded and attached along bottom and side edges to form the bag. The attachment is typically made by a zipper.

Sleeping bags are often folded and rolled into a tight cylinder for storage. After rolled, most rolled rectangular sleeping bags are tied with tie cords, compression straps, or elastic straps, or may be otherwise secured so that the sleeping bag does not become unrolled during storage.

In general, when a sleeping bag is put on display at a store, it is desired that the sleeping bag look large, or fluffy, so that a user will believe that the fill for the sleeping bag is sufficient to keep the user warm is also comfortable. Thus, if possible, the sleeping bag is presented so that it looks rather large. However, for shipping, particularly shipping overseas, it is desired that the sleeping bag be compacted as small as possible so that shipping charges, which often are set by volume, may be minimized per sleeping bag.

These two different goals are hard to meet in a single sleeping bag container. Moreover, because the use of store personnel is expensive, stores do not want their employees to have to re-package items, such as sleeping bags, so that the items can be placed on a shelf.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In accordance with an embodiment, a tightly rolled sleeping bag is provided. In accordance with a method of the invention, the tightly rolled sleeping bag is rolled using conventional equipment, but pressure is applied to an end of the sleeping bag so as to cause the sleeping bag to be more tightly rolled than previous sleeping bags. Moreover, rolling tines for a rolling machine for rolling the sleeping bag are tapered so as to aid in removal of the tightly rolled sleeping bag. In addition, a fixed bar on the rolling machine is positioned closer to the tines so that it may hold a completely rolled sleeping bag in the tighter configuration.

In accordance with an embodiment, one of the fixed bar and the rolling tines is adjustable relative to the other so that different thicknesses of sleeping bags may be rolled by the rolling machine. Alternatively, one of the fixed bar and the rolling tines may be pressure sensitive so as to hold different thicknesses of sleeping bags in place.

In accordance with another embodiment, a storage sack is provided for holding the sleeping bag. The storage sack is configurable between a first arrangement where the storage sack holds the sleeping bag in the tight configuration, and a second arrangement where the storage sack may be released and expands to hold the sleeping bag in a less tightly rolled configuration. In accordance with an embodiment, to provide such a function, an expansion section is provided on the storage sack. In addition, in accordance with an embodiment, a closure is provided on the expansion section.

In accordance with an embodiment, the tightly rolled sleeping bag is shipped to a store in the tightly rolled arrangement, with the storage sack in the smaller, unexpanded state. Upon arrival at the store, a store clerk opens the closure, such as by removing a tab, to allow the storage sack to expand to the expanded state. By doing so, the storage sack expands to look soft and thick, which may be more attractive to consumers.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
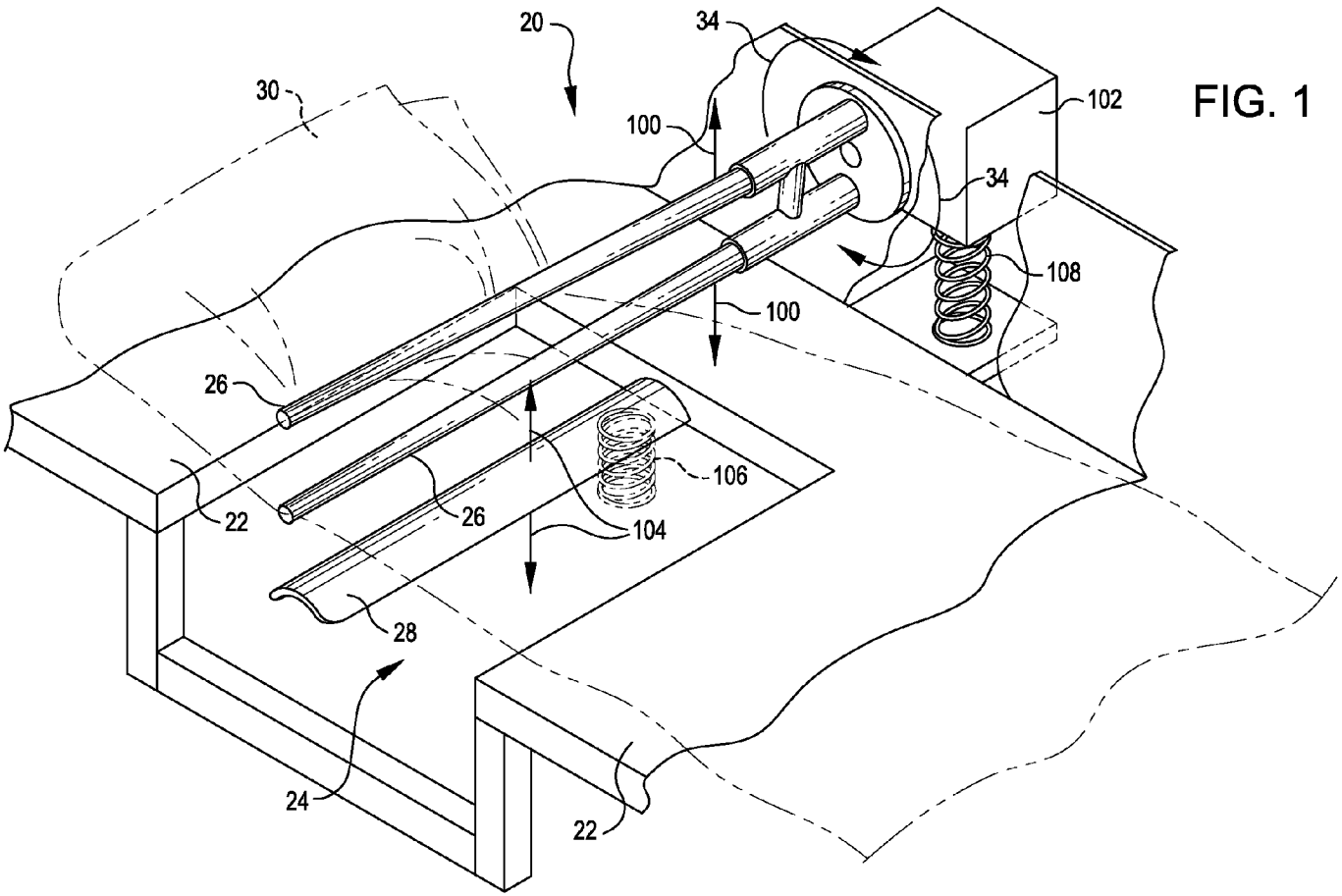
FIG. 1 is a side perspective view of a sleeping bag rolling machine for use in accordance with a method of the present invention.

Referring now to the drawings, in which like reference numerals represent like parts throughout the several views, FIG. 1 shows a side perspective view of a rolling machine 20 that may be utilized for rolling a sleeping bag in accordance with a method of the present invention. The rolling machine 20 includes a table 22 having an opening 24. A pair of roller tines 26 are positioned over the opening 24, and a fixed bar 28 extends across the opening 24, parallel to and underneath the roller tines 26. In operation, the roller tines 26 rotate as generally indicated by the arrows 34 in FIG. 1.

In the embodiment shown in the drawings, the roller tines 26 are attached to an "H" shaped base, when in turn is attached to a circular base plate. The roller tines 26 may alternatively be attached directly to the base, for example by welding, or another suitable structure.

In general, the sleeping bag rolling machine 20 is known in the art. However, modifications to the sleeping bag rolling machine 20 have been made, and a change in the method of rolling a sleeping bag is utilized, to produce a tightly rolled sleeping bag that is much smaller in diameter than prior rolled sleeping bags utilizing similar sleeping bag rolling machines.

Figure 2:
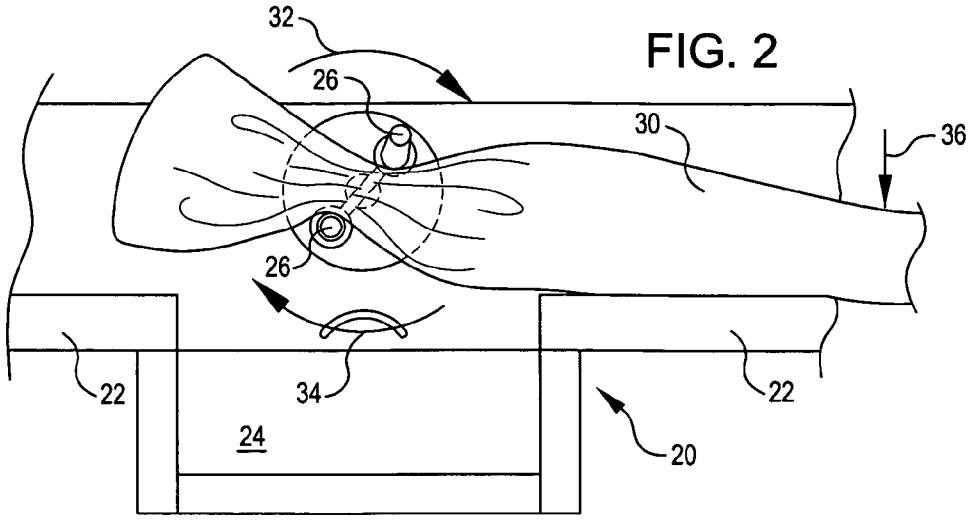
FIG. 2 is a side view of the sleeping bag machine of FIG. 1, with a sleeping bag mounted therein, and shown at a beginning stage of rolling the sleeping bag.

As is known, when rolling a sleeping bag such as a sleeping bag 30 shown in FIG. 2, utilizing the sleeping bag rolling machine 20, an end of the sleeping bag 30 is initially extended through the two roller tines 26, such as is shown in FIG. 2. The sleeping bag 30 may be folded lengthwise prior to inserting it into the roller tines 26. A portion of the sleeping bag 30 extending beyond the roller tines 26 is then folded over on top of the other portion of the sleeping bag 30, as is indicated by the arrow 32 in FIG. 2. Then, in accordance with the prior art, the user holds this extended portion of the sleeping bag 30 into place and then causes the roller tines 26 to rotate in the direction shown by the arrows 34 in FIGS. 1 and 2. This rotation of the roller tines 26 cause the sleeping bag 30 to be rolled into a cylinder.

In accordance with an embodiment of the present invention, the user applies force to the sleeping bag 30 while it is rolling, resisting rolling of the sleeping bag 30. Such a force is indicated by the arrow 36 in FIG. 2, and may be supplied, for example, by putting a hand on the sleeping bag 30 or two users' hands on the sleeping bag 30. This force on the sleeping bag 30 resists the sleeping bag 30 moving toward the roller tines 26, and causes the sleeping bag 30 to be pulled tighter. As such, the airiness or fluffiness of the sleeping bag 30 is reduced, resulting in the sleeping bag 30 being rolled tighter on the roller tines 26. The user maintains this pressure on the sleeping bag 30 while the sleeping bag 30 is being rolled on the roller tines 26. The pressure is sufficient to pull the sleeping bag 30 taut, but enough release is permitted so that the sleeping bag 30 may be continually rolled onto the roller tines 26.

Figure 3:
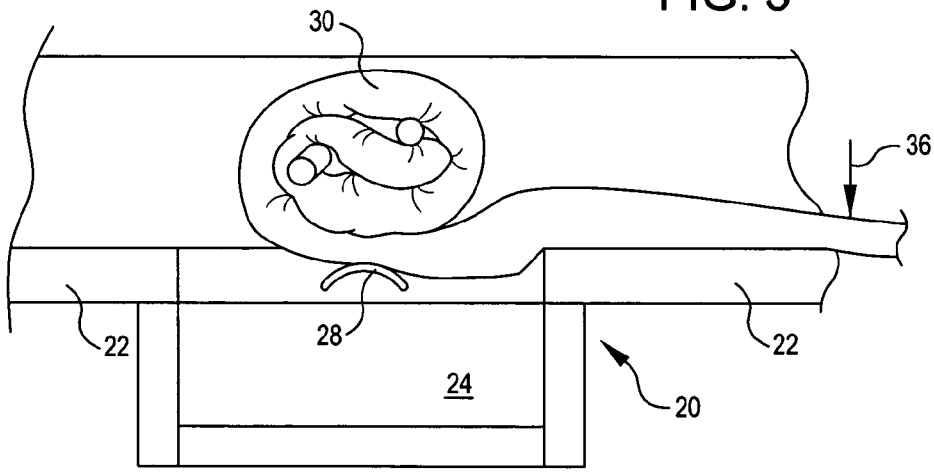
FIG. 3 is a side view of the sleeping bag rolling machine of FIG. 2, shown in a further stage of rolling the sleeping bag.
Figure 4:
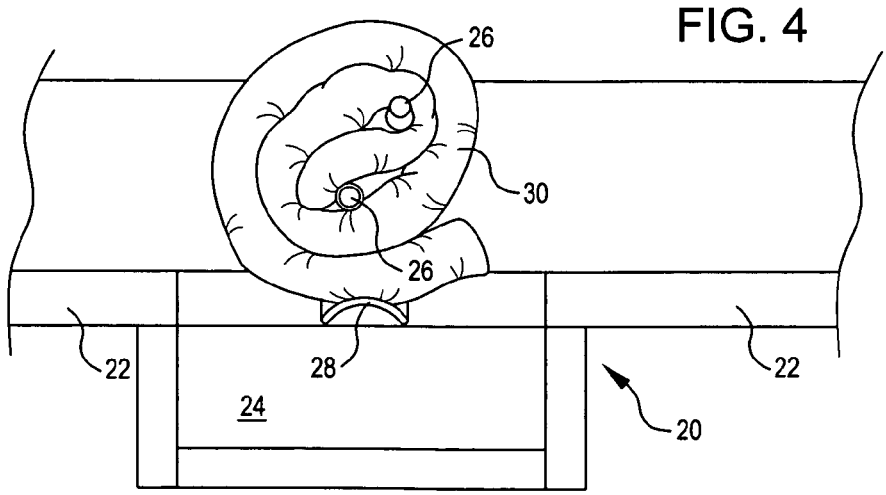
FIG. 4 is a side view of the sleeping bag rolling machine of FIGS. 2 and 3, showing the sleeping bag fully rolled.

A continued stage of rotation is shown in FIG. 3. The user continues to apply pressure until the sleeping bag 30 is completely rolled, such as is shown in FIG. 4. At this stage, the fixed bar 28 holds the end of the sleeping bag 30 in position, preventing it from unrolling. To this end, the fixed bar 28 is appropriately spaced from the roller tines 26 so that it may apply the appropriate amount of pressure to prevent release of the sleeping bag 30 from the roller tines 26. Because the sleeping bag 30 is rolled tighter than prior art sleeping bags, in accordance with an embodiment of the sleeping bag rolling machine 20, the fixed bar 28 is positioned closer to the roller tines 26 so that the fixed bar may hold a completely rolled sleeping bag in the tighter configuration.

To provide appropriate spacing, the roller tines 26 may be movable toward and away from the fixed bar 28, such as is indicated by the arrows 100 in FIG. 1. To this end, a drive unit 102 for the roller tines 26 may be slidably mounted to the sleeping bag rolling machine 20, permitting the drive unit and the roller tines 26 to slide upward. Similarly, the fixed bar 28 may be slidably mounted to the sleeping bag rolling machine 20, and may move in the direction of the arrows 104. Alternatively, both may be movable. In addition, if desired, one or both may be biased, such as by a spring (a representation shown in phantom in FIG. 1 as 106 and 108, for the fixed bar 28 and the drive unit 102, respectively), to permit the fixed 28 and the roller tines 26 to apply appropriate pressure to the rolled sleeping bag 30.

Figure 5:
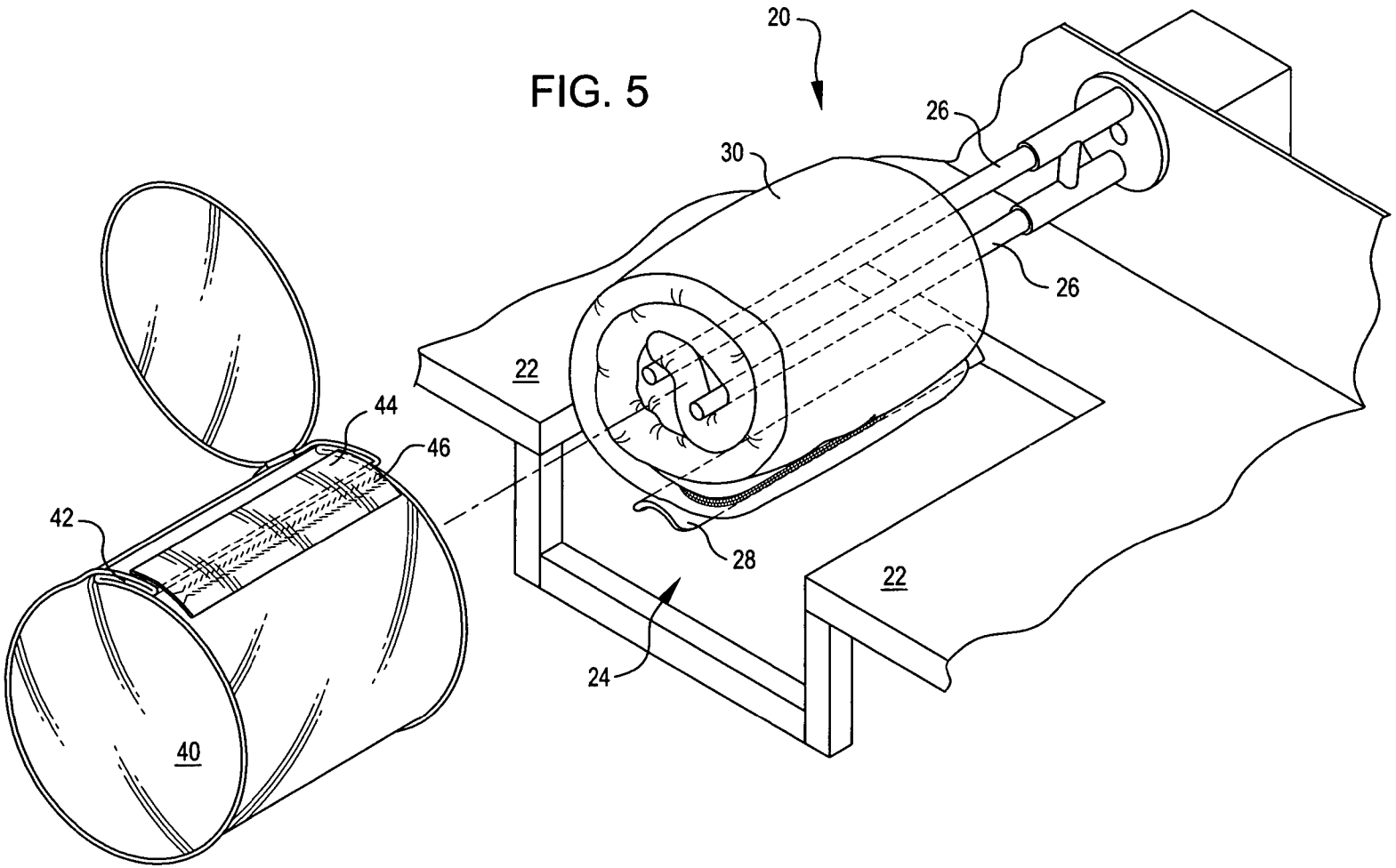
FIG. 5 is a side perspective view of the sleeping bag rolling machine of FIG. 1, with the sleeping bag fully rolled as shown in FIG. 4, and just before a storage sack is placed over the sleeping bag.

After the sleeping bag 30 is fully rolled (FIG. 4), a storage sack 40 (FIG. 5) is extended around the sleeping bag 30. The opening 24 in the sleeping bag rolling machine 20 provides ample room for extending the storage sack 40 over and around the sleeping bag 30. This method of applying a storage sack over a sleeping bag is utilized with prior art sleeping bag rolling machines.

After the storage sack 40 extends fully over the sleeping bag 30, the operator pulls backward on the sleeping bag 30 and the storage sack 40 to remove the sleeping bag 30 from the roller tines 26 and the fixed bar 28. To aid in this removal, in accordance with an embodiment of the sleeping bag rolling machine 20, the roller tines 26 are tapered. One or more of the roller tines 26 may be tapered substantially along their length, even tapered linearly along their length, as shown in FIG. 1. This feature permits easier removal of the sleeping bag 30 from the roller tines 26, especially in arrangements wherein the sleeping bag 30 is rolled tightly.

Using the rolling method described above, significant volume savings can be realized in packing a sleeping bag for shipping. For example, for one prior art sleeping bag sold by the assignee of the present invention, The Coleman Company, Inc., a standard sleeping bag size 33 inches by 75 inches, with a polyester fiber fill and fill weight of 4 pounds, which previously was rolled to a diameter of 13.75 inches, now is rolled to a diameter of 10.25 inches. In a second example, a large sleeping bag, having a size of 39 inches by 81 inches, with a polyester fiber fill and fill weight of 6 pounds, which was previously rolled to a 16 inch diameter, is rolled to an 11.5 inch diameter. In both these examples, the sleeping bag is folded lengthwise before rolling. As can be realized, such volume reduction can significantly reduce shipping volume, which in turn reduces cost per unit of the sleeping bag 20.

In accordance with an embodiment, the storage sack 40 includes an expansion section 42 (FIG. 6) in its casing. The expansion section 42 is configured to permit the storage sack to increase in volume, and may be any suitable structure including elastic or another expandable structure, but in the embodiment shown is a portion of the storage sack 40 folded onto itself so as to make the storage sack 40 smaller. The storage sack 40 is shown in this smaller, unexpanded state in FIG. 6.

Figure 6:
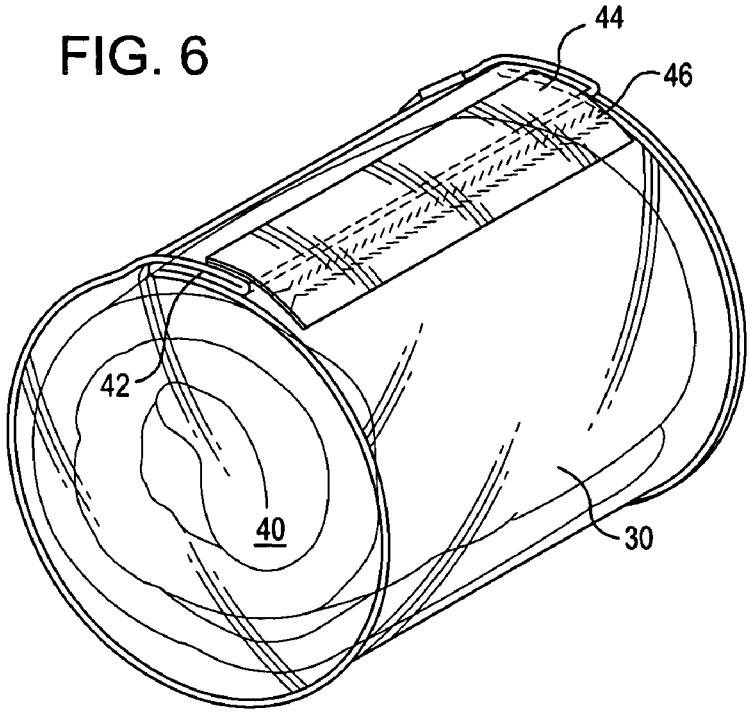
FIG. 6 is a side perspective view of the sleeping bag as rolled in FIG. 5 and within the storage sack, with the storage sack in a smaller, unexpanded state.

In accordance with an embodiment, a closure 44 is provided for maintaining the expansion section 42 of the storage sack 40 in the smaller, unexpanded state. The closure 44 in the embodiment shown in FIG. 6 is a large adhesive strip having a removable tab 46 extending along its length. However, other closures may be used, including, but not limited to, ties, hook and loop fasteners, loop and toggle fasteners, zippers, buttons, snaps, releasable adhesives, and releasable fasteners.

Figure 7:
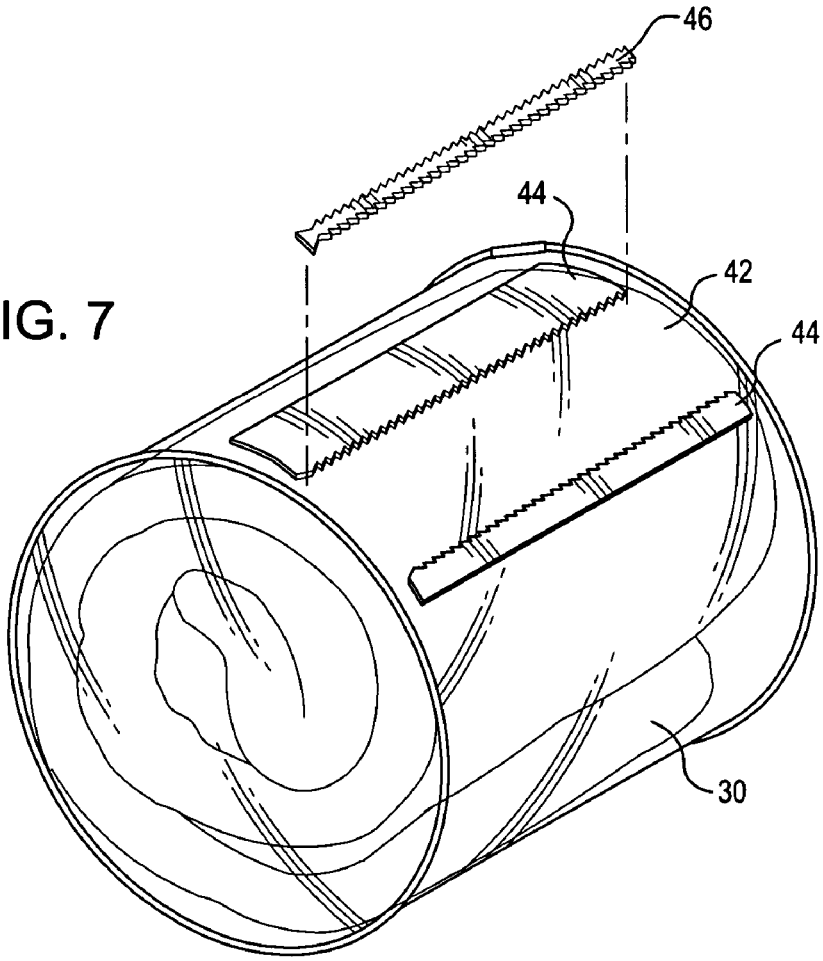
FIG. 7 is a side perspective view of the storage sack and sleeping bag of FIG. 6, with the storage sack expanded to an expanded state.

In the embodiment shown, the sleeping bag 30 is shipped to a store or other retail location with the storage sack 40 in the smaller, unexpanded state shown in FIG. 6. Then, when the sleeping bag 30 arrives at the store and is ready to be put on the shelf, a store clerk may open the closure 44, in the embodiment shown by tearing off the removable tab 46, allowing the storage sack 40 to expand to the expanded state shown in FIG. 7. In this position, the sleeping bag 30 is allowed to expand in the storage sack 40, giving the sleeping bag 30 a much fuller, softer, fluffier appearance. This appearance may be more suitable for sale of sleeping bags, especially where consumers are looking for a softer, warmer sleeping bag.

However, if desired, if the store wishes to preserve shelf space, the sleeping bag 20 may be placed on a shelf with the storage sack 40 maintained in the smaller, unexpanded state as shown in FIG. 6, permitting more sleeping bags to be stacked on the shelf. Alternatively, one or more of the sleeping bags may be expanded to the expanded state shown in FIG. 7, while others are maintained, for example, on a higher shelf, in the smaller, unexpanded state shown in FIG. 6. In either event, the storage sack 40 permits the sleeping bag 30 to be presented in two different ways with very little work by a store clerk.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rolling machine for a sleeping bag, comprising:

roller tines onto which the sleeping bag is rolled, the roller tines being tapered to aid in removal of the sleeping bag from the rolling machine, and a fixed bar for holding a sleeping bag in position against the roller tines when a sleeping bag is rolled in a tight configuration, wherein the fixed bar is biased toward the roller tines.

2. A rolling machine for a sleeping bag, comprising:

roller tines onto which the sleeping bag is rolled, the roller tines being tapered to aid in removal of the sleeping bag from the rolling machine; a fixed bar for holding the sleeping bag in position against the roller tines when the sleeping bag is rolled in a tight configuration, wherein the roller tines are biased toward the fixed bar.

3. A rolling machine for a sleeping bag, comprising:

roller tines onto which the sleeping bag is rolled, the roller tines being tapered to aid in removal of the sleeping bag from the rolling machine, and a fixed bar for holding a sleeping bag in position against the roller tines when a sleeping bag is rolled in a tight configuration, wherein the fixed bar is adjustable toward and away from the roller tines.

4. A rolling machine for a sleeping bag, comprising:

roller tines onto which the sleeping bag is rolled, the roller tines being tapered to aid in removal of the sleeping bag from the rolling machine, and a fixed bar for holding a sleeping bag in position against the roller tines when a sleeping bag is rolled in a tight configuration, wherein the roller tines are adjustable away from and toward the fixed bar.

* * * * *